US011179624B2

(12) United States Patent
Boult

(10) Patent No.: US 11,179,624 B2
(45) Date of Patent: Nov. 23, 2021

(54) SYSTEMS AND METHODS FOR ONE-HANDED SNOWBOARD STRAPPING

(71) Applicant: Terrance E Boult, Colorado Springs, CO (US)

(72) Inventor: Terrance Edward Boult, Colorado Springs, CO (US)

( * ) Notice: Subject to any disclaimer, the term of this patent is extended or adjusted under 35 U.S.C. 154(b) by 0 days.

(21) Appl. No.: 16/858,650

(22) Filed: Apr. 26, 2020

(65) Prior Publication Data

US 2020/0384344 A1 Dec. 10, 2020

Related U.S. Application Data

(60) Provisional application No. 62/840,324, filed on Apr. 29, 2019.

(51) Int. Cl.
*A63C 10/06* (2012.01)
*A63C 10/14* (2012.01)

(52) U.S. Cl.
CPC ..... *A63C 10/06* (2013.01); *A63C 10/14* (2013.01)

(58) Field of Classification Search
CPC ..... A63C 10/06; A63C 10/14
See application file for complete search history.

(56) References Cited

U.S. PATENT DOCUMENTS

| | | | | |
|---|---|---|---|---|
| 2,023,054 | A * | 12/1935 | Johannessen | A63C 9/22 280/619 |
| 5,857,700 | A * | 1/1999 | Ross | A63C 10/04 280/623 |
| 6,293,566 | B1 * | 9/2001 | Carpenter | A63C 10/04 280/14.21 |
| 6,412,794 | B1 * | 7/2002 | Phillips | A43B 3/0073 280/14.22 |
| 6,416,075 | B1 * | 7/2002 | Laughlin | A63C 10/04 280/624 |
| 6,543,159 | B1 * | 4/2003 | Carpenter | A43B 3/0073 36/115 |
| 7,516,976 | B2 * | 4/2009 | Cunningham | A43C 11/146 280/11.36 |
| 2004/0075246 | A1 * | 4/2004 | Davies | A63C 10/22 280/623 |
| 2009/0025529 | A1 * | 1/2009 | Perrotta | A45F 3/14 84/327 |
| 2012/0211968 | A1 * | 8/2012 | Saunders | A63C 10/045 280/623 |
| 2017/0216710 | A1 * | 8/2017 | Debney | A43B 7/12 |

* cited by examiner

*Primary Examiner* — Brian L Swenson

(57) ABSTRACT

The invention allows riders to quickly and effortlessly strap in and out of their bindings with only one hand, with embodiments for top-entry bindings, rear-entry bindings and hybrid-bindings. The invention can be integrated into bindings or delivered as after-market add-on products that re-use and adapt the riders existing binding.

20 Claims, 7 Drawing Sheets

*Shows an embodiment of a one-handed strap and keyhole interfacing to pivot pin attachment to top-entry or hybrid bindings.*

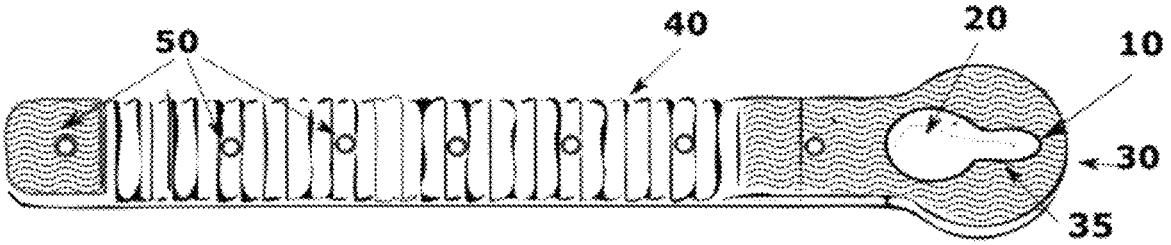
Figure 1: *one embodiment of a One hand Strap with keyhole and guide holes for use on a top-entry or hybrid binding..*

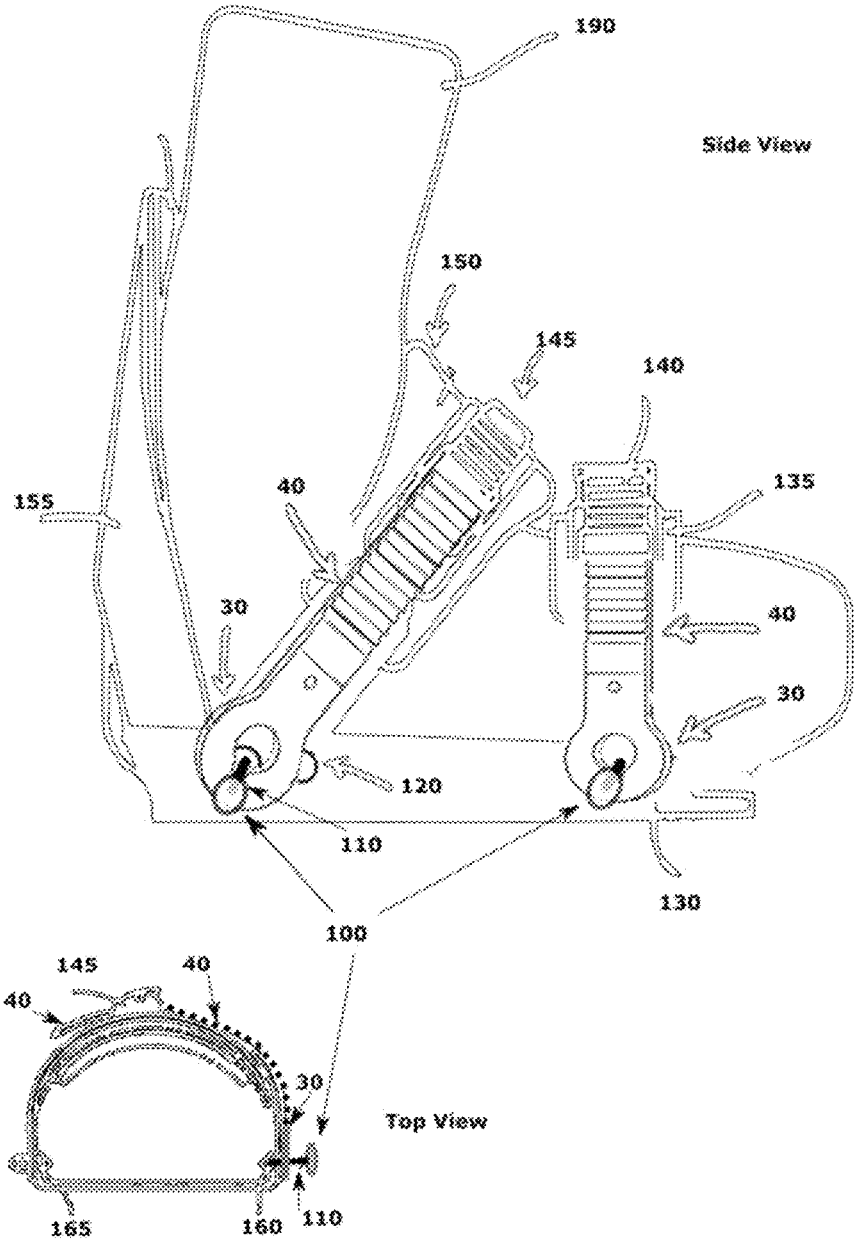
Figure 2: *Shows an embodiment of a one-handed strap and keyhole interfacing to pivot pin attachment to top-entry or hybrid bindings.*

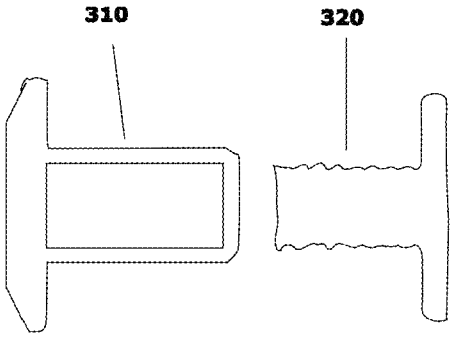
Figure 3: Example Pivot Pin

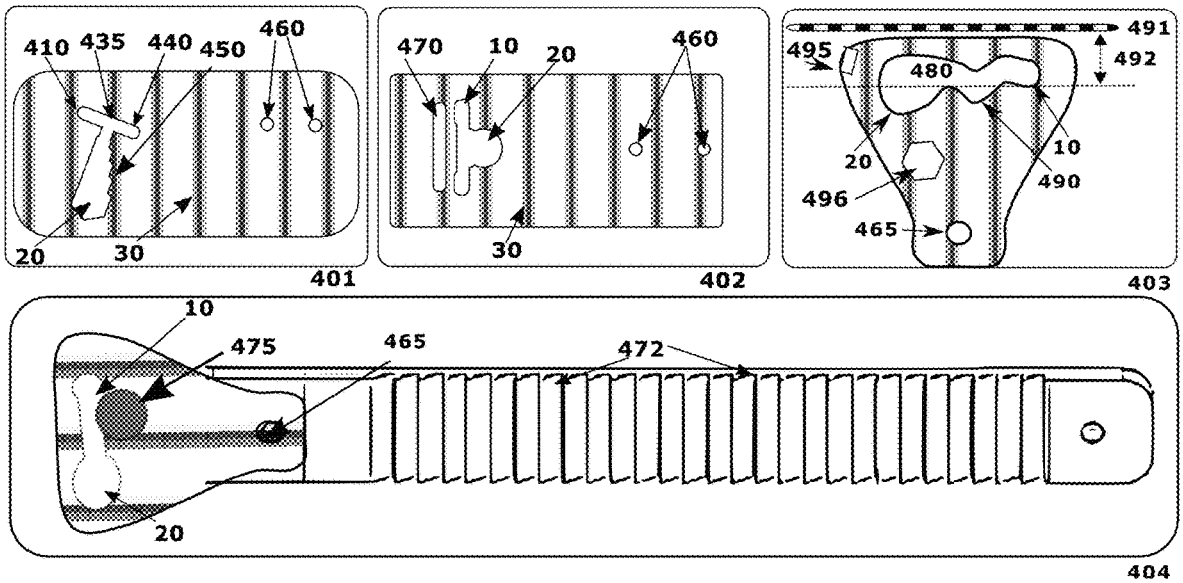
Figure 4: Embodiments using just an attachment for an existing strap showing enhanced keyhole.

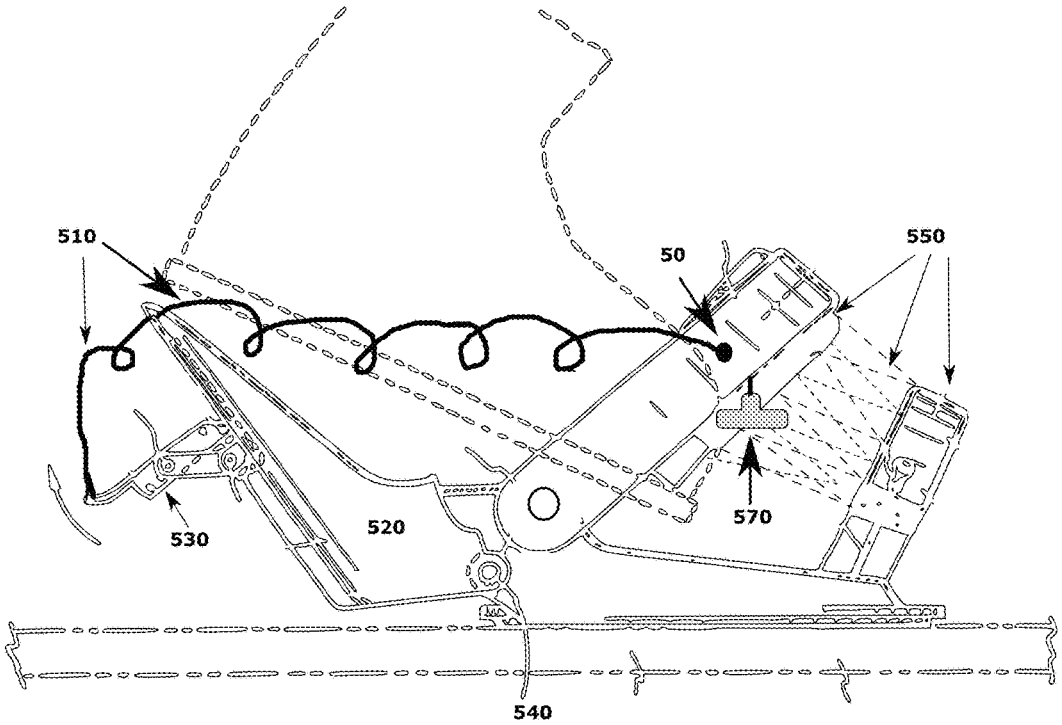
*Figure 5: Drawing of an embodiment of one-handed strap for use in a rear-entry binding design.*

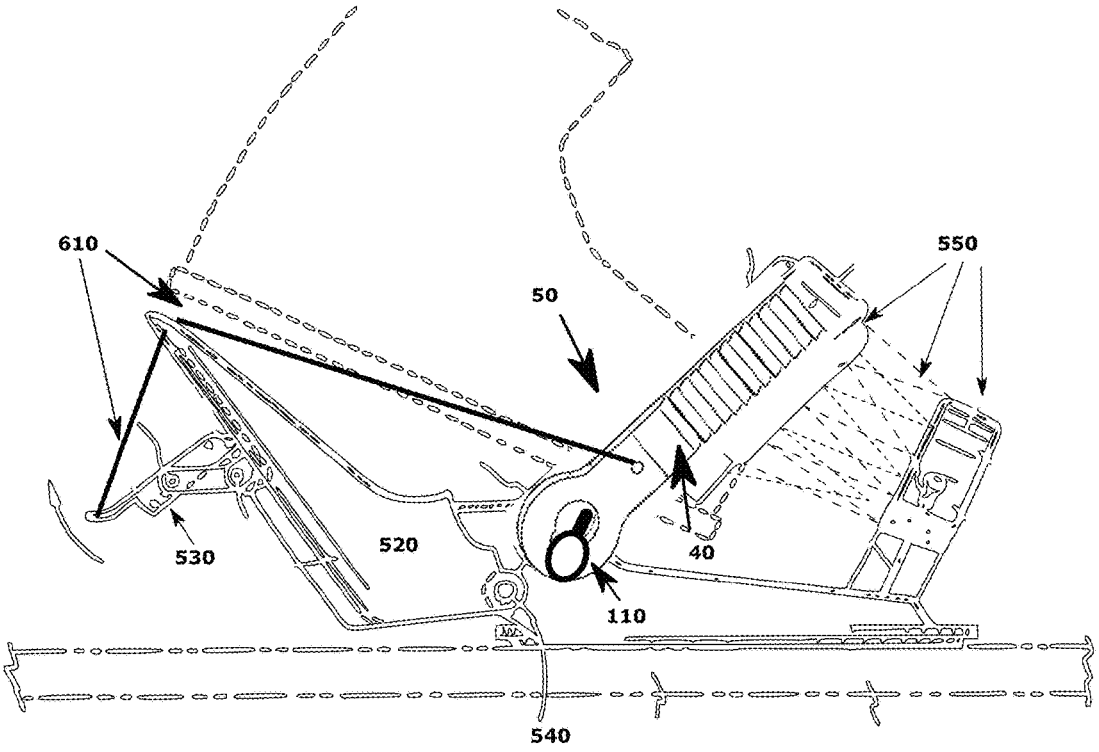
*Figure 6: Drawing of an embodiment of one-handed strap for use in a hybrid binding design.*

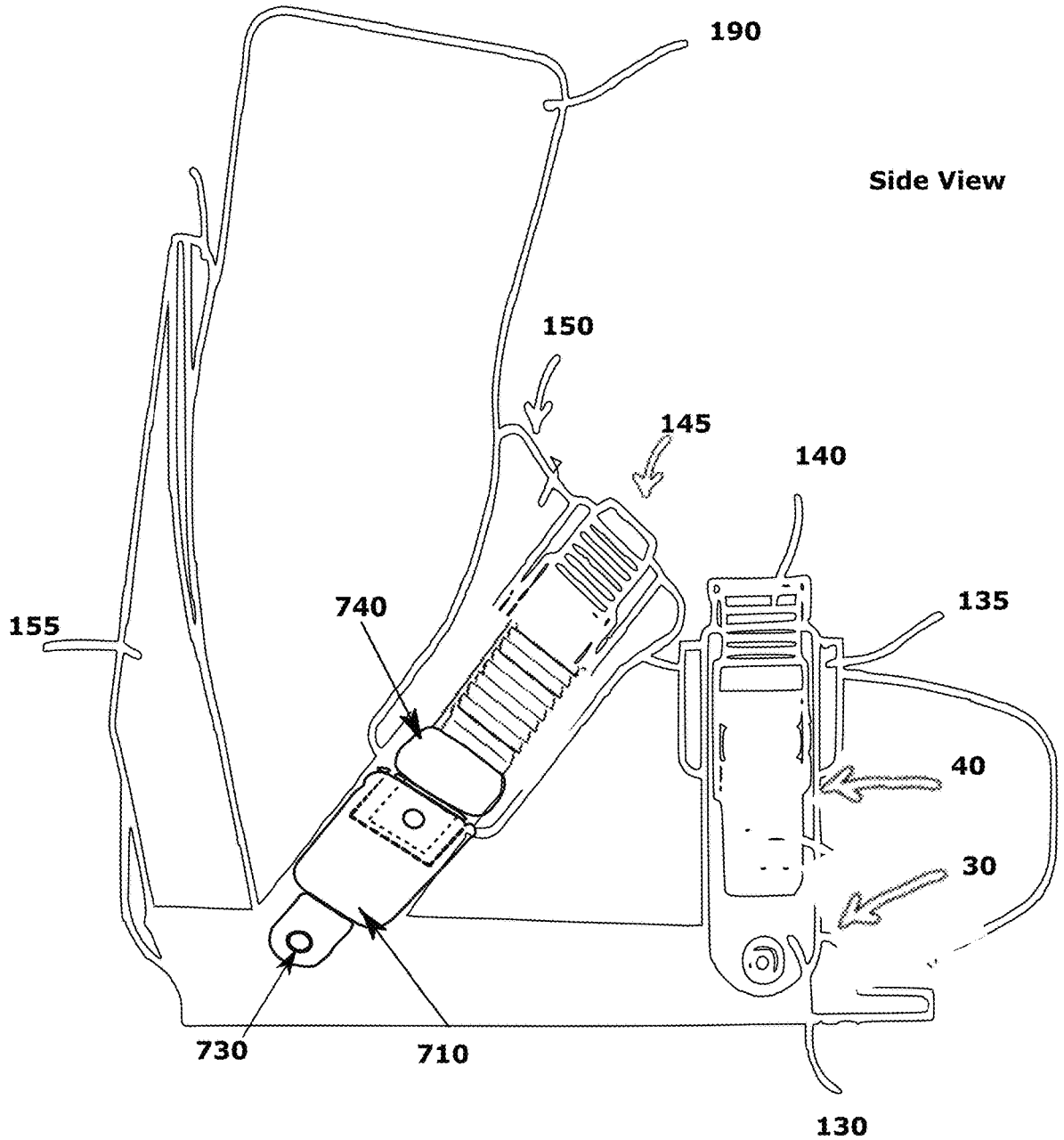
*Figure 7: Drawing of an embodiment of one-handed strap with a rotating member attached to binding.*

SYSTEMS AND METHODS FOR ONE-HANDED SNOWBOARD STRAPPING

This application claims the benefit of U.S. Provisional Patent Application No. 62/840,324 filed Apr. 29, 2019, which is incorporated by reference herein in its entirety.

1. TECHNICAL FIELD

The present application relates to attaching soft boots to objects with particular application to soft boot snowboard bindings.

2. BACKGROUND AND RELATED ART

Snowboard bindings provide the critical connectivity between a rider's foot and the rider's boot that is connected to the snowboard (hereinafter "board"). Unfortunately, attaching existing strapping is often cumbersome and inherently challenging because not only do standard bindings require the rider to bend over and use two hands to attach the strapping, it requires that the rider will probably have to sit down to perform the task. Furthermore, it is most likely that the rider is wearing gloves that make it difficult to manipulate the fine manipulation required of standard straps. Lastly, it is most likely a task that needs to be performed in snow, in cold conditions that make the flexibility of standard strapping rigid and unresponsive to large padded gloves.

For the case of rear-entry bindings, the rider is forced to bend completely down and then reach far behind themselves to grab the proper section of the binding, again, in the cold with large, padded, cumbersome gloves, to delicately operate a part of the binding.

The present invention addresses and overcomes the aforementioned challenge of the standard binding with embodiments that allow riders to easily and effortlessly strap in and out of their bindings with only one hand and do so while wearing large padded gloves for the cold and still standing up. Herein, we present the following intermediate designs, which, although not as easy as a step-in-binding, improves accessibility while also being much simpler to manufacture, which results in the present invention being considerably much less expensive. Additionally, it should be noted that unlike the prior art, the present designs are add-ons to existing bindings allowing the riders to retain their current investment in the binding they already own.

The need for easier entry leads to a range of multiple designs for step-in bindings with specialized boot such as U.S. Pat. Nos. 5,722,680A, 6,189,913B1, 6,270,110B1, US20050138849A1, U.S. Pat. No. 9,149,711B1, US20170216710A1. Unfortunately, these designs require specialized boots, which limits their usefulness. Furthermore, these designs, while easy to step into, have difficulty when there is snow on the bottom of the boot. Additionally, these designs don't provide the same secure level of connectivity to the user's foot, the boot, and the snowboard, reducing ride quality and feel. In essence, the present invention creates an easy to adjust, seamless connection between the rider's foot, boot and snowboard that the rider will inherently feel and more connected to and in complete control of their board.

We could find no prior-art on how to adapt rear-entry bindings for one-handed use. In regards to rear-entry bindings, U.S. Pat. Nos. 5,692,765A, 8,827,280B2, EP2086652B1, EP0787512 A1, DE202008000714U1, the common denominator is that while they all do allow one-hand operation and the ability for a rider to use their existing boots, these rear-entry patents, unfortunately, require that the riders 1) reach behind their boot to adjust complex components and 2) spend considerably more money to attain some level of support and control.

There have also been improved strap designs such as U.S. Pat. Nos. 6,267,390B1, 7,306,241B2; however, these are designed to allow easier adjustment of the tightness, not for one-handed attachment for easier entry and exit. Interestingly, U.S. Pat. No. 7,306,241B2 includes an optional hook+loop element that is introduced to overcome the difficulty of their design. This is achieved by an added tightening cable that attempts to keep the two-element strap from separating sufficiently far to allow the rider to enter and exit their board. But rather than teaching of this as the primary way to provide easy entry and exit, the provided patent teaches (Column 5) a means to address the problem of the tightening element coupling by using the standard two straps which may no longer be sufficiently separated enough to permit entry and exit. The prior art, in this case, describes a simple hook-catch mechanism to allow expansion to get around the cabling of their design. Their motivation is overcoming a new limitation of their own design, not related to one-handed easy attaching.

Furthermore, we have tested multiple simple hook catch designs similar to the design sketched in U.S. Pat. No. 7,306,241B2 as well as the more complex designs in U.S. Pat. No. 5,586,367A. The experiments we performed showed that the mechanisms of the prior art were not designed for self-rotation because if the latch was not parallel to the strap angle, which varies by rider, the fit was uncomfortable. More significantly, our testing showed that these aforementioned designs, comprised a simple straight catch in a triangular hook, while easily attachable, would then also disengage far too easily if the straps accidentally became loose—they were not secure and hence not well suited to snowboarding. We note that since the design of U.S. Pat. No. 7,306,241B2 includes a novel tightening mechanism, this loosening may not be a difficulty in their design but also note the full U.S. Pat. No. 7,306,241B2 design added significant complexity and cost.

The inventor has decades of snowboarding experience and invention experience and has researched and prototyped over a dozen different one-hand or step-in designs over a multi-year period, before discovering the current invention. Not only is the current invention more effective than prior-art, but the current invention also allows a significantly reduced cost for a single-handed secure connection for top-entry bindings and simple, low-cost adaption of rear-entry and hybrid designs. Once the idea of a one-handed strap attachment is presented, hindsight bias may make it seem obvious, but for more than 20 years of snowboard, designers have failed to have the insight to combine these ideas to make quick attach one-handed straps; instead, they have been developing ever more complex design for easy entry snowboard bindings as in U.S. Pat. Nos. 5,722,680A, 6,189,913B1, 6,270,110B1, US20050138849A1, U.S. Pat. No. 9,149,711B1. The present invention is a non-obvious tradeoff—it is not as easy for entry as either a step-in binding or rear entry binding but is significantly easier than the two-hands needed for standard snowboard strapping, or the reach-behind of rear-entry binding.

To best of our knowledge, there have been no teachings for any type of snowboard strap/binding combinations where the strap itself was designed for rapid one-hand attachment. The closest match to this concept is U.S. Pat. No. 5,857,700A, which teaches of a bar mechanism that connects to both straps into a harness that can then interface with a quick-release mechanism—the strap itself is not released, rather the bar connecting them is released. The U.S. Pat. No. 5,857,700A patent does not discuss easy one-hand strapping in, and the design is considerably more complex with the need for an added bar, and latching means, the alignment of the straps is restricted to the connecting bar and does not provide the level of ankle/heel support of traditional strap bindings or the rotational elements needed for comfortable use. In contrast, the present invention modifies an individual strap so that the single independent strap is quick to attach and has no added moving parts.

Not only are there no teachings on the combination of keyholes for snowboard binding straps, within the snowboard industry, but the motivation to pursue such a design also is not obvious because binding straps are already easily separated from the ratchet and not viewed as needing to be easily removed from the snowboard binding. Furthermore, keyhole attachments elements are already used in the snowboard industry, e.g., for attaching bindings to the board (WO2012102420A1) or ridged studs on boots directly to the binding, and other applications of attacking ridged object to other ridged objects, but not for flexible objects like straps. Even when the keyhole strap design is first mentioned, it would likely be dismissed as having too high a risk of having the strap come loose—when the ideas were presented to the mechanical engineering design team commissioned to develop better designs, and they dismissed the idea as not viable. Apparently is not that obvious that the natural combination of the tension from normal strap ratcheting and a sufficiently long/complex keyhole channel would result in making the keyhole connection stable even on a curved flexible attachment like strap over a boot that will occasionally loosen up during use.

In the space of keyhole+stud designs, there are more complex "locking" versions, e.g., U.S. Pat. No. 7,562,422B2, US20090025529A, which could be adapted to the current invention though testing has shown that the complex keyhole patterns described herein have been sufficient to prevent accidental release and are both cheaper to manufacture and do not require the complex "unlocking" step which makes it more difficult to release without bending over further. Our simple novel designs with a friction element via spring or rolling washer, provide more security with much less cost.

3. SUMMARY

The fundamental idea of this invention is the ability to use flexible members and appropriately chosen attachment and rotation points to allow basic one-handed attachment to a snowboard binding with sufficient security to navigate on simple terrain such as getting off a lift or on the flats, and with that to then allow the user to fully secure the binding will moving along.

This omnibus specification presents related embodiments to solve the drawbacks of the prior art because the presented invention comprises products that one can seamlessly affix to their existing boot and binding with only one hand and without having to reach as far behind and below the boot. Furthermore, the present inventions make it possible to securely affix the boot even when snow adheres to the bottom of the rider's boot while maintaining security if some of that snow causes a loosening of the boot. Additionally, the present inventions provide a simple retrofit mechanism for increased flexibility and robustness, all while not adding moving parts to an existing binding.

While there is a primary element for the invention because existing binding comes in many forms, the invention takes on many different embodiments, to simplify the discussion we first discuss the application in a traditional top-entry strap-based binding, then we present its application in typical rear and hybrid entry models. The core idea of a flexible attachment, rotation for comfortable use, and one-handed operation apply across all models, and those skilled in the art will find this teaches a broad set of methods that can be applied to almost soft boot snowboard binding. But because each model is a bit different, we described different embodiments in sufficient detail to allow the implementation of the preferred embodiments on different types of bindings while also demonstrating the general concepts. While we describe everything in terms of snowboard boots and bindings, the overall design applies to any binding of feet/boots to objects and hence could be applied in snowshoes, skis, waterskis, and other sports.

4. BRIEF DESCRIPTION OF THE DRAWING

FIG. 1: shows an embodiment of a One hand Strap with simple keyhole and guide holes for use on a top-entry or hybrid binding.

FIG. 2: Shows an embodiment of a one-handed strap with keyhole interfacing to pivot pin attachment to top-entry or hybrid bindings.

FIG. 3: Example of Pivot Pin

FIG. 4: Shows multiple embodiments using just attachments for existing strap showing enhanced non-linear keyholes FIG. 5: Drawing of an embodiment of a one-handed strap for use in a rear-entry binding design.

FIG. 6: Drawing of an embodiment of a one-handed strap for use in a hybrid binding design.

FIG. 7: Drawing of an embodiment of a one-handed strap with a rotating member attached to the binding.

5. DETAILED DESCRIPTION OF THE PREFERRED EMBODIMENTS

The first embodiment of the invention provides a novel quick-connect and quick-release binding strap design that can be seamlessly retrofitted on existing top-entry bindings. In one embodiment, the present invention also provides a keyhole design for safety that is easy to use. Said keyhole design also functions as a pivoting point for comfort and stability. The design of the present invention allows entry and exit while using only one gloved hand. The simple design inherently allows for increased robustness, and the ability to retrofit with existing bindings means increased usability for owners of existing bindings, and lower end-rider total cost.

The core element of this embodiment is a novel strap design with a first keyhole binding region, 10, a section at the end of a larger opening, and a second entry hole, 20, on the wide end of the strap, 30.

This simple embodiment employs a straight-line communication, 35, between the keyhole binding region, 10, and the entry hole, 20. The straight-line communication is simpler to use and manufacture, while at the same time, compared to a simple hook/catch, it reduces the risk of an accidental release if the strap is slightly loose. However, since the strap is to be ratcheted down tightly to provide a secure connection with the board, the tension on the strap provides a secure connection as long as the pivot pin's head is even larger than the keyhole binding region, 10 or the communication region 35. There is an inherent tradeoff in the length of the communication 35, the safety of retaining the strap, the amount of ratcheting needed to achieve tightness. Our experiments with this type of linear aligned communications regions, 35, have found that it should include a travel distance of at least 0.375 inches and ideally 0.5 inches so that if the strap does become loose, e.g., from snow underfoot eventually coming out, the rider can feel the loosening while the strap is still in the communication channel and still secure from release.

In this embodiment, the strap has standard tooth/gearing ladder sections, 40, for interfacing with a standard snowboard binding ratchet. At various locations along the strap, there can be small guide holes, 50, that allows for a locking fixture such as a screw or tie-wrap that can be added after placing the strap through the ratchet, thereby preventing the strap from being accidentally removed from the ratchet as the rider quickly releases the ratchet mechanism. The holes 50 also support connecting multiple straps together for extension and also provide a guide for a wire strap for rear-entry designs.

FIG. 2 shows the preferred attachment of the strap, 30, 40, to the binding with both a heel/ankle strap with ratchet, 145, with pad, 150, and a toe-arch strap with ratchet, 140, with pad, 135. The base plate, 130, is presumed to have one or more mounting holes, 120, where the rider can select a point of attachment to provide the most flexible/comfortable mounting angle for the rider's boot and leg, 190. On selected bindings, the highback, 155, may also provide mounting holes. In this case, the strap itself interfaces with the pivot pin, 100, which has an extended head flange, 110. We use the term pivot pin rather than the more traditional stud because the ability to pivot so the strap can attach at different angles is a functional element of the design. The pivot pin is attached, 160, to the binding base, 13, through a standard mounting hole, 120, with a nut or other attachment mechanism on the end of the pivot pin. The opposite side of the binding has its standard mounting pin, 165. The diameter of the pivot pin's flange, 110, should closely match the diameter of the binding region of keyhole, 10, on the strap, and the head of the pivot should be much larger than the binding and communication region of the keyhole, while still being smaller than the large entry hole, 20. This is the critical component that makes this invention non-obvious for snowboard bindings since, without tension and a smaller keyhole, the strap would be at risk of popping off while the rider is snowboarding. The security of the rider depends on a combination of tension plus the flange 110 of the pivot pin being sufficiently large that the strap cannot come off in the binding region, 10, or communication channel, 35, and the strap can only come off through the larger entry hole, 20. The drawing of the pivot pin in FIG. 2 is not to scale; normally, there would only be a small gap between the pivot pin flange and strap to improve the security of the strap connection.

In addition to security, the keyhole design makes one-handed operation easier as the strap will stay in place after sliding the pin into the keyhole, allowing the rider to then reach up and use the same hand to ratchet to tighten down the strap. Once tightened, the tension inherently keeps the pivot pin, 100, in the keyhole binding region, 10, and provides for a secure connection between the boot, 190, and the binding, 130, while allowing the strap, 145, to pivot for the comfort of the fit.

FIG. 3 shows an alternative example Pivot Pin that could be a type Chicago-screw with receiving element, 310, and a screw element, 320. The pivot pin will interface with the keyhole binding region to allow the fast strap to rotate to provide the proper strap angle needed for the rider's boot. The use of a pivot connection is an integral part of standard snowboard strap attachment; however, it is critical to note that state-of-the-art quick release boot mechanisms do not incorporate this invention's pivot that automatically adjusts the strap angle. This overcomes a prior limitation since different riders' boots, 190, will vary in size, attaching a strap at a fixed angle as illustrated in prior art U.S. Pat. No. 5,857,700A, or as a flat non-rotating hook as illustrated in US20170216710A1 reduces rider's comfort and stability. The present inventions pivot improves comfort and stability.

An important novelty of the present invention is that with the combination of pivot pin attached to binding, and the strap with keyhole, the resultant is that the rider never needs to remove the strap from the ratchet. The traditional approach of reinserting a strap into the ratchet is what takes two hands, one to hold the strap and the second to hold the ratchet or its strap, then guiding one strap into the ratchet while maintaining alignment of the two parts. Conversely, with the present invention, to connect the strap to the board, the rider simply slides the larger strap entry hole, 20, over the flange, 110, on the pivot pin, 100, and then ratchets down the strap which tightens the keyhole portion against the pivot pin which rotates as it tightens, providing a secure while comfortable connection. Furthermore, with said flange, 110, being larger than the keyhole binding section, 10, and communication channel 35, even if the strap loosens slightly, e.g., because of packed snow beneath the boot breaking free, the strap will not come off over the flange. When riders release the strap, they use the standard release on the strap ratchet which frees up sufficient slack in the strap that the entry hole, 20, can be aligned with the flange, 110, and the strap can be removed over the flange, 110, completely releasing the strap.

While the pivot pin's flange, 110, could be achieved using a screw with a large head as a pivot pin, e.g., a truss or sidewalk screw, an alternative would be to use a standard screw for the pivot pin with a washer and spacer. The spacer would provide a better pivot by reducing friction between the straps and the screw threads while also providing a fixed spacing from the pivot pinhead to the body of the binding. With a spacer, a larger washer could then be provided at the pivot head end to increase the effective diameter of the flange, 110, while keeping the cost lower by using standard parts such as screws, washer, and spacers.

Multiple alternative embodiments are shown in FIG. 4. This class of embodiments provides strap adapters with keyholes that can be attached to the riders' existing straps, thereby extending them into the one-handed fast-connect strap design. We found no prior art suggesting a motivation for an attachment to a snowboard strap for any purpose other than lengthening. These embodiments would reduce the material needed for the production of the invention and increase the universality as it would be independent of the size or width of the snowboard strap and increases value for the rider since they could retain their existing straps and binding.

The first embodiment in FIG. 4, 401 shows an adapter with a more complex keyhole, one where the path for the pivot pin is not a straight line—the non-linear path locks in the pin and reduces the risk of accidental release when the strap is loose, e.g., between the time of initial attachment and the tightening of the ratchet. The T-shaped region, 440, of the non-linear communication region, 435 to 450, provides increased security if the strap becomes loose because the pivot pin will tend to move linearly and will be captured by the T-region, 440, where it will remain attached. To remove the pivot pin, the pin must be aligned with the center of the T region 435. Testing found that for a pivot pin with a 0.2" head, a T-shape with a 0.375" to 0.5" top length, 410 to 440, optimal for the balance of keeping the overall attachment length small while being sufficient for a rider to detect any loosening, with the ideal size depending on the size of the channel and pivot pin, with larger pivot pins requiring longer T shapes. For any adapter design, multiple alignment/mounting holes, 460, could provide for both attachment and support to keep the attachment from rotating on the strap and keep the T-region, 410 to 440, of the keyhole aligned relative to the strap/tension direction, as well as providing for length adjustment.

An alternative embodiment of a non-linear keyhole is shown in the second attachment embodiment, 402 of FIG. 4. In this design to help make sure the pin does not release accidentally, the embodiment includes a second gap, 470, in a slightly flexible material to act as a spring-like mechanism, such that the pin can be pushed against the flexible material which bends slightly and then as the pin slides to the end of the keyhole is held in place by the friction of elastic material. To release the keyhole, the rider must overcome the force of the flexible material's spring action friction. While shown with smooth keyhole, it could also be a toothed/ridged region to increase security. While shown as a short T, it could incorporate a longer T shape or have the entry hole, 20, at the end of the region, so that the communication region is larger. From experimentation, the top of the T should be between 0.6 and 1 inch so the rider can feel the looseness before there is much risk of release. Another embodiment would use added material such as rolling washer extending into the communication channel, providing the opportunity to replace the friction material as it becomes worn. Many other types of friction designs are within the current art.

The right example embodiment attachment, 403, in FIG. 4 has a complex curved communication region, 480, between the entry point, 20, and pivot binding region, 10. The communication region being a smoothly varying shape that makes it easier to slide the pivot pin along the inside of the keyhole in a continuous motion—sharp angles as in the previous invention with L-shaped non-linear communication regions (e.g., GB2448727A), makes it difficult to slide the mechanism, without rotation, especially when one cannot see the communication region and sharp corners also increase manufacturing costs when using CNC, or waterjet cutting as the sharp angles are more difficult to manufacture.

In addition, the smooth communication region, 480, the embodiment 403 includes a secondary catch point, 490, where the pivot pin will catch if the strap is loose and accidentally moving along the communication region. In most keyhole designs, the binding region, 10, the entry point, 20, and communication region are all aligned, but in these attachment embodiments, they are not. This allows for increased security with a shorter distance between the mounting, 60, and binding regions, which is important so as to not to overly increase the total length of the snowboard strap. In one embodiment, 403, the entry point, 20, full communication region, 480, and binding point, 10, are all near the far edge of the attachment with respect to the mounting point, 60. This type of design, a pivot pin attached to the binding in close proximity to the board, 491—the narrow separation, 492, allows the full connection/sliding to accommodate a pivot pin near the board. That embodiment also shows a narrow neck region around the single pivoting mounting point, 60, which can be useful when region for connection to the strap is narrow while also allowing the whole attachment to rotate as it is tightened to keep the forces between the strap, the mounting point, 60, and the keyhole binding region, 10, all aligned. A secondary advantage of the tapered design 403, is that on some binding where there is no screw location for the toe binding strap, one of the tapered designs may be used to go in toe strap insert area and thereby provide a location for mounting the pivot pin.

The bottom embodiment, 404, of FIG. 4, shows an adapter is attached to a standard strap, 472, which can be achieved via one or more screws+nuts holding it in place through the mounting hole 465. That adapter example also shows a linear communication between the keyhole, 20, and the binding position, 10, but with an added friction wheel, 475, that could be a rubber washer added to provide friction as the pivot pin slides along the channel. The friction region could be a replaceable part to extend product life while maintaining the friction.

Providing secondary uses can also be incorporated into the design with minimal cost. If the designs 401 and 403 are made from sufficiently strong metal, e.g., 14 gauge or larger steel, the communication channels 480 or 450 also functions as a bottle opener and the 403 adapters can be configured as a multi-tool with a screwdriver edge, 496, and hex-head wrench region, 495, for working on the snowboard/binding. The hex-head region 495 may be sized to match the nuts, 160, that hold the pivot pin to the binding the attachment to the strap, thereby ensuring the rider always has the tools needed to maintain the strap adapter. With more flexibility, the communication region 450 of the keyhole in the 401 adapters is configured as a series of overlapping hexagonal regions that can provide a wrench for different size hex nuts. This is a novel keyhole design that serves as a wrench and bottle opener and provides more useful value for the rider at minimal to no higher manufacturing cost.

Alternative designs that vary the third dimensional (out of the drawing plane) thickness of the material, e.g., the main adapter 30 being 2 mm thick while the pivot binding region, 10, is either thicker, e.g., 2.25 mm, to help hold the flange of the pivot pin in place, or so that the entry 20 or communication region 480 is thicker/higher, so the pivot pin is less likely to accidentally slide into that region. Rather than varying the actual material thickness, varying offset in the third dimension might be achieved by stamping the keyhole area to be non-planar, which could also add structural strength to the design. Combinations of all three design elements can obviously be combined.

An attachment, as in FIG. 4, would be of great benefit would be for riders whose straps are non-standard, so the ladder strap design of the first embodiment might not fit their existing ratchets. Obviously, one embodiment of this design could be made by cutting off the design in FIG. 1, or it could be designed with more complex and more secure keyhole designs, as in FIG. 4. In addition, the non-linear communication regions of these designs and keyhole designs could be used on full straps as well as attachments.

On some bindings, the toe strap region does not have an obvious place to mount the pivot pin without drilling a hole in the binding. In one embodiment, the pivot pin is added to one of the existing straps, which generally have holes for adjusting the size of the strap. The strap or adapter can then go over the strap-attached pivot pin rather than a pivot pin through the binding. This can leave the other side of the strap to use the existing ratchet on the other side of the toe strap. Alternatively, an adapter, e.g., 403, can be provided to go through the binding region and provide a position for mounting the pivot pin.

In an alternative embodiment, shown in FIG. 7, has the rotating locking receiving member, 710, is attached to the binding at a rotation joint, 730. The flexible strap has the mating element of the locking mechanism, 740. The rotation joint, 730, should have enough friction that the rotating locking receiving member, 710, will stay in position even when a slight force is applied to it. The example is shown with a seat-belt style locking mechanism, but any rotatable secure locking mechanism could be used. A standard seat-belt type connection, while secure, would be difficult to guide the slot into the locking mechanism while wearing gloves, but a modified form with a larger opening funnel to direct the slot would alleviate that problem. While these locking mechanisms can be secure, they will likely cost more than the keyhole/pivot-pin mechanism and hence are only likely to be useful for a high-end rider.

The above describes a few embodiments but are not meant to be restrictive or exhaustive. Those skilled in the art will see a wide range of alternatives in for designs, from strap material choices, strap design around the keyhole, keyhole depth and design, pivot pin material, pivot pin design, spacer material, and locking mechanisms.

Not all bindings use top entry with ladder straps and ratchet as the primary entry/exit to the boot. A well-known alternative binding design uses straps to hold a fixed or movable top material over the foot, while the foot enters/exits the binding from behind and is wedged into the upper material, such as described in U.S. Pat. No. 5,918,897A. Alternative rear-entry designs use straps as the upper material but still use rear entry and the primary entry/exit, e.g., U.S. Pat. No. 5,692,765. In such designs, see FIG. 5, the rider has to reach behind their foot nearly to the ground to grab the highback, which has the locking mechanism on its backside facing the ground. Such reaching is difficult and uncomfortable for many riders and nearly impossible for others like the inventor who is not flexible and cannot even touch his toes.

The application of the invention can make the securing of the binding easier. In one embodiment of a design for rear-entry bindings, as shown in FIG. 6, a secondary flexible connecting means, 510, is connected through one of the multiple holes, 50, in the binding strap described above, with the flexible connection means to or through the binding's highback, 520. This design allows the rider to either pull the end of the flexible connecting means, e.g., via a handle 570, or to grab the flexible strap itself 510 to pull up the back of highback 520. The flexible connecting means might be a self-coiling coil of wire or flexible cable.

When pulled it, if connected to the rear locking mechanism, 530, behind the highback 520, the resulting pull can lock the binding in place with a single pull of a handle, 570. Since the handle 570 is on/near the front/side of the foot, and well above the ground level, this is much easier and more comfortable. In one embodiment, the wire is guided through a hole In the highback, but Another alternative would add a screw-on or mechanism to the highback rather than having to drill a hole in it. Even if pulling does not fully engage the rear locking mechanism 530, once the highback 520 is lifted up by pulling the wire 510 or handle 570, it is considerably easier to fully engage the rear locking mechanism 530 as it will be much higher and more accessible.

The novelty of this embodiment is the unique ability of the rider with the gloved hand simply pulling on a highly accessible cord 520 or handle 570 that results in an efficient means to lock into the rear entry binding. If just connected to the highback, 520, the wire can lift the highback to a level that the highback locking mechanism, 530, can be grasped with less bending. The flexible strap (wire), 510, being higher than the binding, reduces the reach needed to engage the binding. For comfort, the fixed mechanism, 550, which is holding the boot, is often comprised primarily of cloth, and hence it might rip if the wire went through it directly. Thus the hole, 50, in the ladder strap provides protection against ripping. Because the wire is regularly being pulled through the hole, even a plastic ladder strap may wear through, so an alternative would be to hook a ring of material through the hole, e.g., a metal ring, and use that to guide the wire. Another embodiment would use a ring that goes around but not through the strap. Another alternative embodiment would not use the ladder strap with holes but would put a protective mechanism in the fixed upper material, e.g., a grommet or a plastic internal element in the upper material and route/connect the second connecting means through that protective mechanism.

Using a self-coiling wire for the flexible strapping member, 510, provides the advantage that after the highback, 520, is lifted into place, the wire will coil up, reducing the risk of it catching or dragging. An alternative would be to have an explicit coiling mechanism mounted along the wire, e.g., mounted on the highback 520, or integral to the handle 570, but that would increase the cost.

The key concept and non-obviousness of the innovation of the improved rear-entry mechanism are that the flexible wire allows easier access with a less stressful reach because the connecting wire is mounted higher on the binding and connected to or through a high section of the movable highback binding. This reduces the distance that must be reached by more than 8 inches and as much as 15 inches. While we have shown embodiments taking advantage of the novel strap design, those skilled in the art will see multiple variations on where to add the second connecting means, the materials to be used, style of handle, attachment to the locking mechanism.

In an alternative embodiment, the flexible wire (510) is directly attached to the strap (550), either through a whole (50) or just wrapped around the strap (550). In this design, the user grabs the coiled section of the strap and pull upward to pull the rear support (520) upward around the pivot point (540). If the coil (510) is pulled hard enough, it will even directly latch the safety mechanism (530).

Another type of "rear-entry" binding space, sometimes called a hybrid binding, has both the rear-entry mechanism of a rear-entry binding with the fully adjustable/removable ratchet arch strap (145) of a top-entry binding. This provides the user with a choice of entry/exit methods, providing both rapid-easy entries of the rear-entry with the high adjustability of the ratchet mechanism of traditional straps. One could apply any of the prior designs to such a hybrid binding. But in applying the invention to such hybrid binding multiple previous designs can be combined, see FIG. 6. In this embodiment, the one-handed strap (40) with keyhole (20) and pin-pivot (110) design can be combined with the flexible strap (610) mechanism. In this embodiment, the flexible strap (610) does not need as much flexibility/coil because when the arch strap (145) is loosened, and the keyhole is released, it will provide slack and allow the rear-entry to open backward without as much flexibility in the strap. To reattach the user can insert their boot then use the detached strap (40) to pull on the flexible wire (510) to pull up the rear plate (520) into place and then use the keyhole to connect to the pivot-pin (110) over the pin lip (100) and then if needed, ratchet the strap tight. An advantage of this design is that the arch region would not be tight when pulling up the rear highback making that easier to do, especially if snow is packed on the boot.

It will be understood by those skilled in the art that various modifications may be made to the embodiments and applications disclosed herein while being consistent with the current invention.

The invention claimed is:

1. A method for one-handed securing of a snowboarding boot to a binding baseplate, the method comprising:

a) a means of attaching a flexible binding strap to a binding baseplate, b) a means capable of positioning the flexible binding strap, such that at least part of said flexible strapping is on the top and front half of the foot so as to be easily reached, c) a means capable of supporting rotation so that at least one end of the flexible strapping means can adjust its angle during and after the initial securing of the boot to the binding baseplate, d) a means capable of allowing a user to adjust the flexible strap to provide an initial securing of the boot to the binding baseplate wherein said means is capable of operation using only one-hand, and e) a means capable of customizing and tightening of the fit of the boot to the binding baseplate.

2. The method of claim 1 for one-handed securing of a snowboarding boot to a binding baseplate wherein:

a) said rotation means is a pivot pin with an enlarged head allowing the strap to rotate even after attachment, b) the flexible strapping includes a keyhole configuration, and c) the means for one-handed operation is to move a larger opening on a keyhole over pivot pin then sliding up to the narrow section of the keyhole to provide an initial securing of the boot to the baseplate.

3. The method of claim 1 for one-handed securing of a snowboarding boot to a binding baseplate wherein:

a) said means of rotation is a hinge-point of a high-back of a rear-entry or hybrid-entry binding, b) the flexible strapping is connected to an upper portion of the rear high-back mechanism and to an element on the front of the binding, and c) the means for one-handed adjustment includes pulling on the flexible strapping to lift the rear high-back approximately into its locking position thus providing the initial securing of the boot.

4. The method of claim 3 for one-handed securing of a snowboarding boot to a binding baseplate wherein:

a) after passing through a connecting region on a high-back, the flexible strapping means is connected to a rear-latching mechanism, and b) the means for one-handed operation includes pulling on the flexible strapping so as to lift the rear-high-back to prove the initial securing of the boot to the binding baseplate as well as and locking the rear-latching mechanism into position to provide a final securing of the boot to be binding baseplate.

5. The method of claim 4 for one-handed securing of a snowboarding boot to a binding baseplate wherein:

a) a second rotating means is provided by a pivot pin with an enlarged head, b) a second flexible strapping means is provided with a keyhole configuration, c) the means for one-handed engagement includes pulling on the first flexible strapping means so as to lift a rear high-back into a position for locking, followed by moving the larger opening on the keyhole of the second flexible strapping means over pivot pin then sliding up to the narrow section of the keyhole to prove an initial securing of the boot.

6. The method of claim 3 for one-handed securing of a snowboarding boot to a binding baseplate wherein:

a) the flexible strapping means has a keyhole configuration that has a non-linear structure to increase security before tightening, and b) the means for one-handed operation includes moving a larger opening on the keyhole over pivot pin then through the non-linear structure of the keyhole to provide an initial securing of the boot.

7. The method of claim 6 for one-handed securing of a snowboarding boot to a binding baseplate wherein:

a) the keyhole configuration is provided by an adapter connected to a standard binding strap.

8. The method of claim 1 for one-handed securing of a snowboarding boot to a binding baseplate wherein:

a) said means of rotation is integrated with the binding and includes an interface so as to provide a rotatable locking receiving interface, b) the flexible strapping means having the mating interface to lock into the rotatable locking receiving interface, c) the means for one-handed operation includes locking the mating interface with the rotatable locking receiving interface to provide an initial securing of the boot.

9. A system for one-handed securing of a snowboarding boot to a binding baseplate, the system comprising:

a) a binding baseplate that can be attached to a board onto which straps can be attached, b) an adjustment mechanism on at least one strap to allow customization and tightening the fit of the boot to the binding baseplate, c) a flexible binding strap member configured and arranged with one end movable and the other to be fixed, directly or indirectly, to the binding baseplate, d) said flexible binding strap member being position on the top or front-side of the binding so as to be easily reached, e) a rotation member to allow adjustment of the angle of at least one end of the flexible strap during and after the initial securing of the boot, and f) an attachment of the flexible strap such that said flexible binding strap member can be operated using only one hand to provide an initial securing of the boot to the binding baseplate.

10. The system of claim 9 for one-handed securing of a snowboarding boot to a binding baseplate wherein:

a) said rotation member is integrated with the binding so as to provide an attached but rotatable locking receiving interface member, and b) the movable end of the flexible binding strap has a mating interface member to securely lock into said locking receiving interface member.

11. The system of claim 9 for one-handed securing of a snowboarding boot to a binding baseplate wherein:

a) said rotation member is a pivot pin with an enlarged head, and b) the movable end of the flexible binding strap member has a keyhole configuration to allow a larger opening to easily engage with the pivot pin while sliding up to a narrow section of the keyhole to provide the initial securing of the boot to the binding baseplate.

12. The system of claim 11 for one-handed securing of a snowboarding boot to a binding baseplate wherein:

a) the flexible binding strap member has a keyhole configuration with a non-linear structure to increase security before tightening.

13. The system of claim 11 for one-handed securing of a snowboarding boot to a binding baseplate wherein:

a) the flexible binding strap member has a keyhole configuration with a friction element to increase security.

14. The system of claim 11 for one-handed securing of a snowboarding boot to a binding baseplate wherein:

a) the keyhole configuration is provided by an adapter connected to a standard binding strap.

15. The system of claim 9 for one-handed securing of a snowboarding boot to a binding baseplate wherein:

a) said rotation member is a rotation joint of a rear high-back b) the flexible binding strap member has a first attachment point on an upper region of the rear-high-back c) the second attachment point of the flexible binding strap is to an element of the binding or straps sufficiently far in front of the rotation joint that pulling upward on the flexible binding strap member provides sufficient torque to rotate the high-back to move it into a position for locking.

16. The system of claim 15 for one-handed securing of a snowboarding boot to a binding baseplate wherein:

a) the flexible binding strap member passes through the high-back before reaching the first attachment point on a rear-latching mechanism the engagement of the flexible strap is such that pulling on the strap provides both sufficient torque to both lift the high-back to provide an initial securing of the boot and also to engage the locking mechanism to provide a final securing of the boot.

17. A system and method for one-handed securing of a snowboarding boot to a binding baseplate comprising:

a) a binding baseplate onto which straps can be attached, b) a flexible binding strap member configured and arranged with one end movable and another other fixed, directly or indirectly, to the binding baseplate, c) said flexible binding strap member being position with at least one end attached in front of a user's ankle so as to be easily reached, d) a rotation member for adjusting an attachment angle of at least one end of the flexible strap during and after an initial securing of the boot, e) a method for one-handed engagement by which said flexible strapping member provides the initial securing of the boot of the boot to the binding plate, and f) an adjustment means on at least one strap to allow customization and tightening of the fit of the boot to the binding baseplate.

18. The system and method of claim 17 for one-handed securing of a snowboarding boot to a binding baseplate wherein:

a) said rotation member is a pivot pin with an enlarged head, b) the movable end of the flexible binding strap member has a non-linear keyhole configuration, and c) the method of one-handed engagement includes moving a larger opening on the keyhole over pivot pin then through the keyhole structure to provide an initial securing of the boot.

19. The system of claim 17 for one-handed securing of a snowboarding boot to a binding baseplate wherein:

a) the flexible binding strap is connected to a rear high-back of a rear-entry or hybrid-entry binding, and b) the one-handed engagement includes pulling on the flexible strap member to lift the rear high-back to provide the initial securing of the boot and put it in a position for locking.

20. The system and method of claim 19 for one-handed securing of a snowboarding boot to a binding baseplate wherein:

a) a second flexible attachment member includes a pivot pin with an enlarged head, b) a movable end of the second flexible binding strap member has a keyhole configuration, and c) the one-handed engagement includes pulling on the first flexible strapping means so as to lift the rear-high-back into in a position for locking followed by moving the larger opening on the keyhole of the second flexible strapping means over pivot pin then sliding up to the narrow section of the keyhole to prove initial securing of the boot of the flexible binding strap.

* * * * *